US006439482B2

(12) United States Patent
Hosoyama et al.

(10) Patent No.: US 6,439,482 B2
(45) Date of Patent: Aug. 27, 2002

(54) FUEL INJECTION SYSTEM

(75) Inventors: Keita Hosoyama; Norihisa Fukutomi; Mamoru Sumida, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/835,110

(22) Filed: Apr. 16, 2001

(30) Foreign Application Priority Data

Jun. 5, 2000 (JP) ..... 2000-168012

(51) Int. Cl.[7] ..... B05B 1/34
(52) U.S. Cl. ..... 239/463; 239/533.12; 239/585.4
(58) Field of Search ..... 239/463, 464, 239/473, 491–493, 533.9, 533.12, 585.3, 585.4, 585.5; 251/129.15, 129.21

(56) References Cited

U.S. PATENT DOCUMENTS 4,887,769 A 12/1989 Okamoto et al. ..... 239/493
4,995,559 A 2/1991 Okamoto et al. ..... 239/493
5,098,016 A 3/1992 Okamoto et al. ..... 239/5
5,630,400 A * 5/1997 Sumida et al. ..... 123/470
5,871,157 A 2/1999 Fukutomi et al. ..... 239/463
5,887,798 A * 3/1999 Ohta et al. ..... 239/585.1
5,954,274 A 9/1999 Sumida et al. ..... 239/533
5,967,423 A 10/1999 Sumida et al. ..... 239/533
5,979,801 A * 11/1999 Munezane et al. ..... 239/463
6,065,692 A * 5/2000 Brinn, Jr. ..... 239/463
6,170,762 B1 * 1/2001 Sumida et al. ..... 239/463

* cited by examiner

*Primary Examiner*—Lisa A. Douglas
(74) *Attorney, Agent, or Firm*—Sughrue Mion, PLLC

(57) ABSTRACT

A fuel injection system capable of improving the degree of atomization and the combustibility of a fuel, including a fuel swirler, a valve seat having a fuel injection port, an annular fuel swirl chamber formed between the fuel swirler and a valve seat and communicating with plural swirl grooves and a fuel injection port, and a valve body adapted to be moved forward and backward in the interior of the fuel swirler in the axial direction thereof and thereby disengaged from and engaged with the valve seat to open and close a communication passage between the fuel swirl chamber and fuel injection port. Let S1, S2 and S3 equal a minimum cross-sectional area of an opening between the valve body and valve seat in the condition in which the communication passage is fully opened, an area of a cross section of the fuel injection port which is perpendicular to the axis thereof, and an average cross-sectional area of a fuel flow in the fuel injection port, respectively. A stroke amount of the valve body is set so that a minimum cross-sectional area of the mentioned opening satisfies the following expression:

$$S3<S1<S2.$$

7 Claims, 5 Drawing Sheets

FUEL INJECTION SYSTEM

BACKGROUND OF THE INVENTION

1. Field of the Invention

This invention relates to a fuel injection system adapted to apply swirling energy to a fuel and supply the resultant fuel to a combustion chamber of an internal combustion engine, such as an automobile engine.

2. Description of the Related Art

Fuel injection systems utilizing the techniques for providing a fuel injection port-carrying valve seat in an outlet of a cylindrical valve casing having a valve body, such as a needle valve and a ball valve therein; turning by a swirler a fuel supplied from the outside; and supplying the resultant fuel to the fuel injection port have heretofore been known from Japanese Patent Laid-Open Nos. 47208/1998 and 205408/1998. According to these techniques, a communication passage between the fuel swirler and fuel injection port is opened and closed by disengaging and engaging a part of a free end portion of the valve body and a part of the valve seat from and with each other. Let S1 and S2 equal a minimum cross-sectional area of a clearance between the valve body and valve seat in the condition in which this communication passage is fully opened, and an area of the cross section of the fuel injection port which is perpendicular to the axis thereof, respectively. A flow rate of the fuel then becomes higher in proportion to S1 and S2.

When the minimum cross-sectional area S1 is larger than the cross-sectional area S2 of the fuel injection port, a fuel having a small amount of swirling energy is injected in large quantities from the fuel injection port in an initial period of a fuel injection operation. Since this fuel has a small amount of swirling energy, the diffusivity of fuel spray and the atomization of the fuel are insufficient, so that the combustibility of the fuel in a cylinder of an engine is deteriorated. Conversely, when the minimum opening area S1 is smaller than the cross-sectional area S2, this problem is solved or lightened. However, when S1 is excessively smaller than S2, a flow resistance of the fuel in the communication passage is high, and this causes the swirling energy applied to the fuel by the fuel swirler to be alleviated, a scatter of an angle of spray to increase or the diffusivity of fuel spray and the atomization of the fuel to become insufficient, and thereby the combustibility of the fuel in a cylinder of the engine to be deteriorated.

The fuel having swirling energy flows through the fuel injection port not over the whole of its cross section S2 but mainly over the portion of a cross section thereof which is near an inner surface of the fuel injection port, so that a void occurs in an inner portion of the fuel injection port. Japanese Patent Laid-Open No. 47208/1998 discloses the techniques for setting S2 larger than S1 for the purpose of stabilizing a flow of the swirling fuel with the void retained but this publication does not refer to the above-mentioned problems occurring when S1 is excessively smaller than S2. On the other hand, Japanese Patent Laid-Open No. 205408/1998 discloses in contrast with Japanese Patent Laid-Open No. 47208/1998 the techniques for setting S2 smaller than S1.

SUMMARY OF THE INVENTION

The present invention has been made in view of the above-mentioned various problems in this technical field and the present condition of the related art, and provides a fuel injection system capable of holding down a decrease in the swirling energy of the fuel and improving the degree of atomization and combustibility of the fuel.

The fuel injection system according to the present invention is (1) a fuel injection system including a cylindrical fuel swirler having plural swirl grooves, a valve seat engaged with a swirl groove-carrying surface of the fuel swirler and having a fuel injection port, an annular fuel swirl chamber formed between the fuel swirler and valve seat and communicating with the swirl grooves and fuel injection port, and a valve body adapted to be moved forward and backward in a cylindrical hole of the fuel swirler in the axial direction thereof and thereby engaged with and disengaged from the valve seat to cause a communication passage between the fuel swirl chamber and fuel injection port to be closed and opened, wherein a minimum cross-sectional area S1 of a clearance between the valve body and valve seat in the condition in which the communication port is fully opened being smaller than an area S2 of the cross section of the fuel injection port which is perpendicular to the axis thereof, and larger than an average area S3 of the cross section of the fuel injection port which is perpendicular to the direction in which a fuel flow advances.

(2) A fuel injection system according to (1) above, in which the fuel swirl chamber is formed so as to be surrounded by walls of the fuel swirler, valve body and valve seat.

(3) A fuel injection system according to (1) above, in which the fuel swirl chamber is formed to a circular annular shape, the swirl grooves extending in a tangential direction of the fuel swirl chamber.

(4) A fuel injection system according to (1) above, in which surfaces of the fuel swirler and valve seat at which these parts contact each other are inclined with respect to the axes thereof.

(5) A fuel injection system according to (4) above, in which an angle of inclination of the mentioned surfaces with respect to the mentioned axes is not smaller than 45° and smaller than 90°.

(6) A fuel injection system according to (1) or (4), in which the average cross-sectional area S3 is determined by using the following equation:

$$S3=(\pi/4)\{De^2-Q^2\sin^2\Theta Di^2\rho/(2gPA^2)\}$$

wherein

De: an inner diameter (m) of the fuel injection port,

Q: a static flow rate ($m^3/s$) of a fuel supplied to the fuel swirler,

A: a total cross-sectional area ($m^2$) of the swirl grooves,

Di: a length (m) two times as large as an offset amount of the center line of the swirl grooves with respect to the center of the fuel swirl chamber, Θ: an angle (°) of surfaces of the valve seat and fuel swirler at which these parts contact each other with respect to the axes thereof, g: gravitational acceleration ($m/s^2$)

P: pressure ($kgf/m^2$) of the fuel supplied to the fuel swirler, and

ρ: density ($kg/m^3$) of the fuel.

(7) A fuel injection system according to (1) above, in which the swirl grooves have a non-square cross-sectional shape, the volume per unit length of each of the swirl grooves of groove bottoms or the portions of the grooves which are in the vicinity of the groove bottoms being smaller than that per unit length of each of the grooves of upper portions of the grooves.

BRIEF DESCRIPTION OF THE DRAWINGS

Preferred embodiments of the present invention will be described in detail with reference to the following figures, wherein.

DESCRIPTION OF THE PREFERRED EMBODIMENTS

Mode 1 of Embodiment

Figure 1:
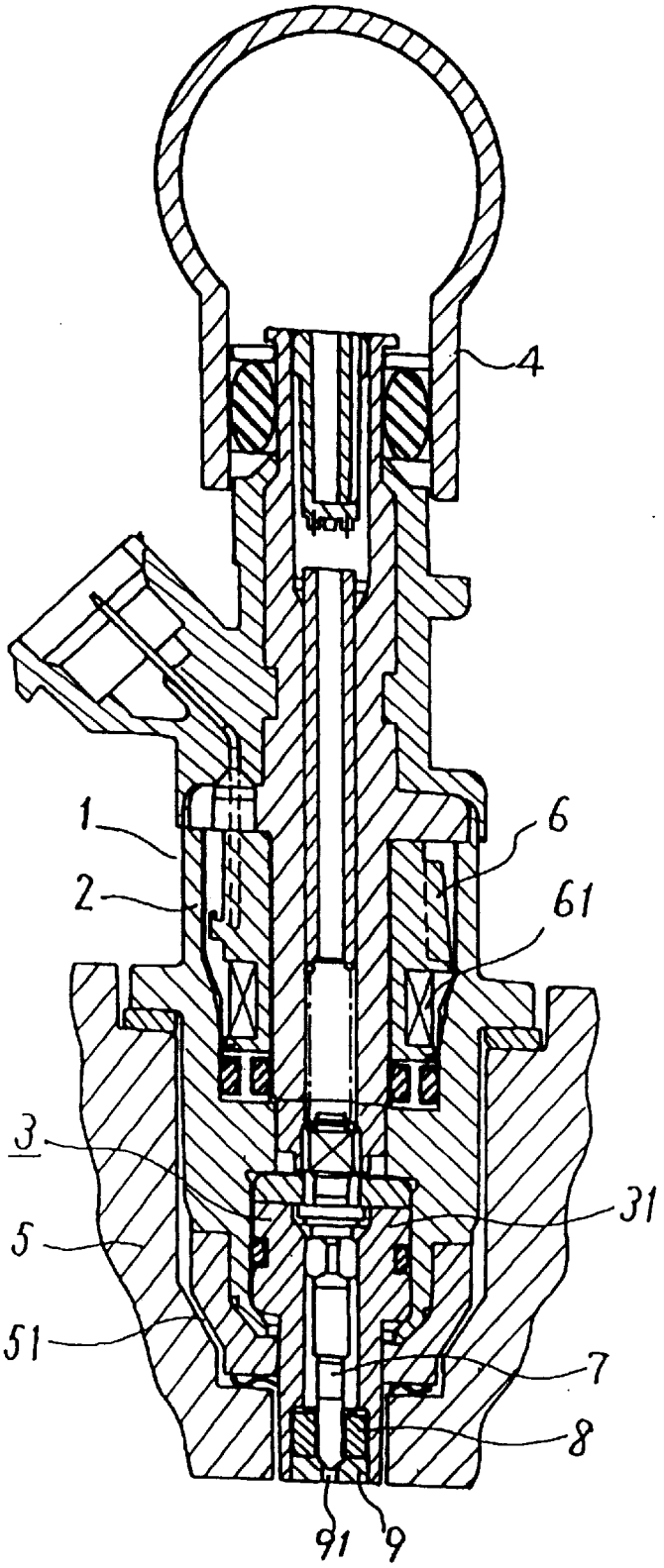
FIG. 1 is a sectional view of a mode 1 of embodiment of the fuel injection system according to the present invention.
Figure 2:
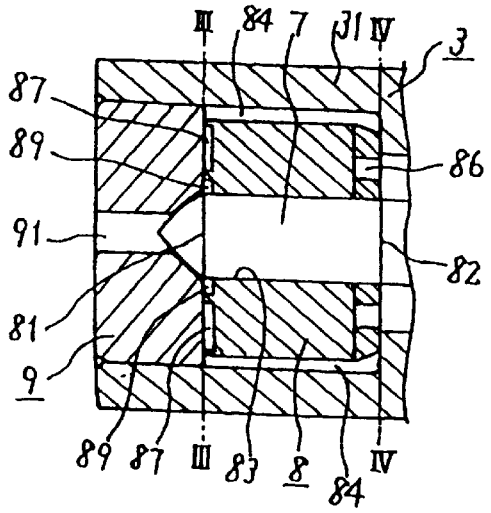
FIG. 2 is an enlarged sectional view of a fuel swirler and a portion in the vicinity thereof in the mode 1 of embodiment.
Figure 3:
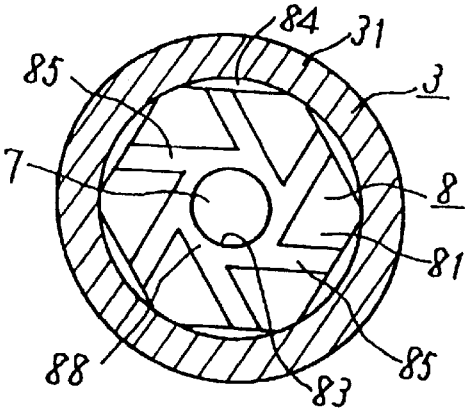
FIG. 3 is a sectional view taken along the line III—III in FIG. 2.
Figure 4:
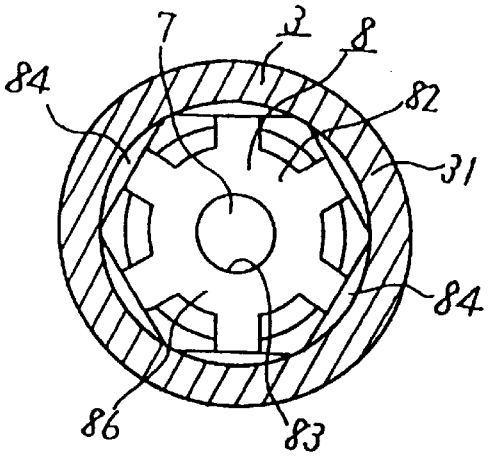
FIG. 4 is a sectional view taken along the line IV—IV in FIG. 2.
Figure 5:
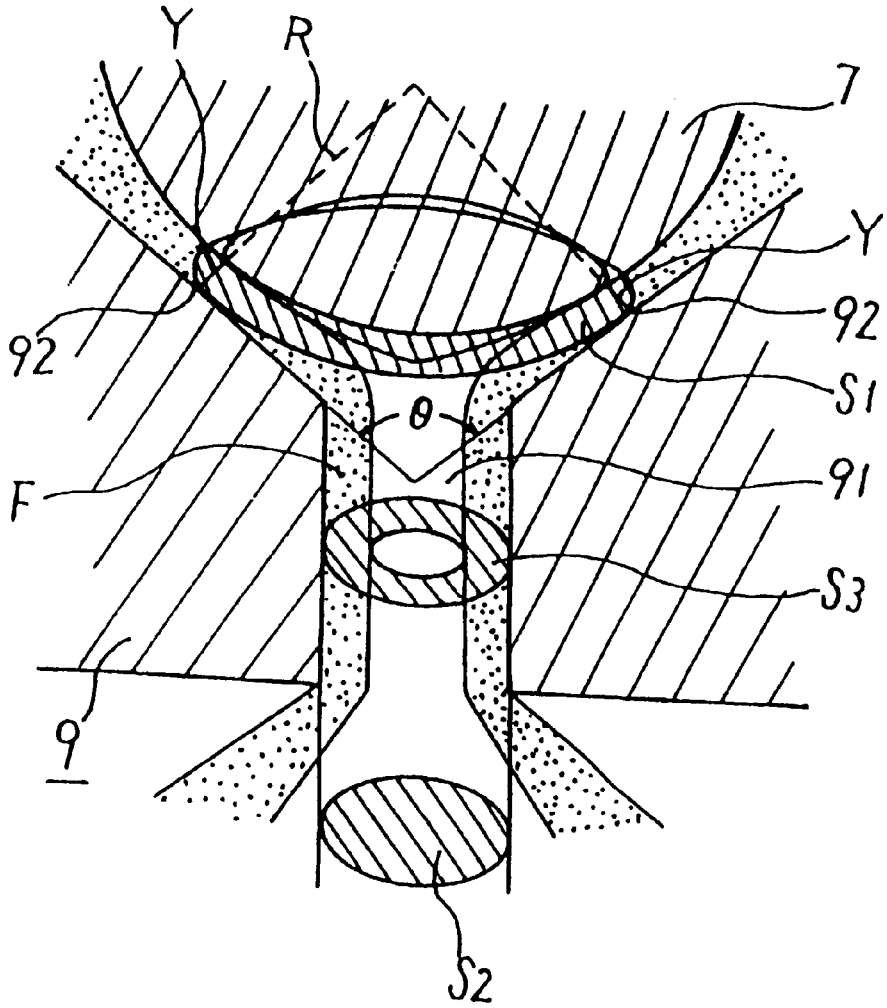
FIG. 5 is a partial enlarged sectional view of a valve seat in the mode 1 of embodiment of the present invention.

FIGS. 1–5 are all such drawings that illustrate the mode 1 of embodiment of the present invention, wherein FIG. 1 is a sectional view of a fuel injection system, FIG. 2 an enlarged sectional view of a fuel swirler and a portion in the vicinity thereof, FIG. 3 a sectional view taken along the line III—III in FIG. 2, FIG. 4 a sectional view taken along the line IV—IV in FIG. 2, and FIG. 5 a partial enlarged sectional view of a valve seat. FIGS. 3 and 4 show in plan a valve seat-side surface and a fuel receiving-side surface respectively of the fuel swirler.

Referring to FIGS. 1–5, a reference numeral 1 denotes a fuel injection system, 2 a housing of the fuel injection system 1, 3 a fuel injection valve, 4 a fuel supply pipe, 5 a cylinder head of an engine, 6 a valve operating unit having an electromagnetic coil 61 and some other parts and adapted to operate a needle valve 7, an example of a valve body. A free end portion of the fuel injection system 1 is inserted and fixed in a fuel injection system inserting hole 51 of the cylinder head 5 of the engine. The fuel injection valve 3 has a structure formed by assembling parts including a valve holder 31, the needle valve 7, fuel swirler 8, and valve seat 9 having a fuel injection port 91. The fuel swirler 8 has the functions of applying swirling energy to the fuel supplied from the fuel supply pipe 4, and supplying the resultant fuel to the fuel injection port 91 of the valve seat 9. A reference numeral 83 denotes a cylindrical hole of the fuel swirler 8, and a free end portion of the needle valve 7 is inserted through the cylindrical hole 83, a free end of the needle valve reaching an inlet of the fuel injection port 91.

As is understood from FIGS. 3 and 4, an outer circumferential wall of the fuel swirler 8 has a hexagonal shape, so that six clearances 84 one side of each of which is shaped like a surface of a convex lens occurs between an inner surface of the cylindrical valve holder 31 and an outer circumferential surface of the fuel swirler 8. These clearances 84 function as fuel passages. A valve seat-side surface 81 of the fuel swirler 8 is provided therein with six cross-sectionally square swirl grooves 85 extending from open ends of the six clearances 84 toward a cylindrical hole 83 of the fuel swirler 8. Between the fuel swirler 8 and valve seat 9, six swirl passages 87 (refer to FIG. 2) formed by the swirl grooves 85 and an outer surface of the valve seat 9 exist. At an open end of the cylindrical hole 83 of the fuel swirler 8, an annular groove 88 concentric with the cylindrical hole 83 is provided, and this annular groove 88, outer surface of the valve seat 9 and a side surface of the needle valve 7 form an annular fuel swirl chamber 89 (refer to FIG. 2). As shown in FIG. 3, the six swirl passages 87 extend in a tangential direction of the fuel swirl chamber 89 to communicate with the fuel swirl chamber 89, which communicates with the fuel injection port 91.

When a fuel supplied from the fuel supply pipe 4 reaches the fuel receiving-side surface 82 of the fuel swirler 8, it flows into the six clearances 84 separately, and reaches the valve seat-side surface 81 of the fuel swirler 8. While the fuel then flows through the swirl passages 87, swirling energy is applied thereto, and the resultant fuel reaches the fuel swirl chamber 89, the fuel being finally injected from the fuel injection port 91 of the valve seat 9. During this time, the needle valve 7 is moved forward and backward in the axial direction thereof in the cylindrical hole 83 of the fuel swirler 8 and thereby engaged with and disengaged from the valve seat 9 to cause a communication passage between the fuel swirl chamber 89 and fuel injection port 91 to be closed and opened.

A mechanism for applying swirling energy to the fuel will now be described. As stated before, the length of the swirl passages 87 is set comparatively large with respect to a cross-sectional area thereof, and, to be more exact, a ratio obtained by dividing the length of these passages by an inner diameter thereof is set to not smaller than two. Therefore, as stated before, the velocity of flow distribution of the fuel flowing at outlets of the swirl passages 87 is substantially made uniform. In this case, the inner diameter of the swirl passages 87 shall be set equal to that of a cross-sectionally circular passage the cross-sectional area of which is equal to that of the swirl passages 87. A velocity of flow $V_1$ of the fuel flowing out from the swirl passages 87 is expressed by the following equation (1):

$$V_1=Q/A \tag{1}$$

wherein Q represents a static flow rate ($m^3/s$) of the fuel supplied to the fuel swirler 8, and A a total cross-sectional area ($m^2$) of the swirl passages 87. In the embodiment of FIG. 3, A represents the sum of the cross-sectional areas of the six swirl passages 87.

The fuel flowing out from the outlets of the swirl passages 87 is merged together in the fuel swirl chamber 89, and the resultant fuel makes a swirling movement. The vorticity $E_1$ of a swirl flow occurring at this time is expressed by the following equation (2):

$$E_1=V_1\ Di \tag{2}$$

wherein Di represents a length (m) two times as large as an offset amount (a distance between the center line of each swirl passage 87 and a line passing the center of the fuel swirl chamber 89 and parallel to the center line of the swirl passage 87).

The fuel turned into a swirl flow in the fuel swirl chamber 89 enters the fuel injection port 91 through a clearance between the needle valve 7 and valve seat 9, and injected to the outside of the fuel injection port 91 as the fuel generates a swirling movement. Referring to FIG. 5, dotted portions F denote a flow of the fuel on the front and rear sides of the fuel injection port 91. A reference numeral 92 denotes a minimum opening between the needle valve 7 and valve seat 9 in the condition in which the needle valve 7 is fully opened, and a reference letter θ an angle of the valve seat 9.

As mentioned previously, the fuel having swirling energy flows through the fuel injection port 91 not over the whole of the cross-sectional area S2 thereof but mainly close to the inner surface of the fuel injection port 91, so that a void occurs in an inner portion of the same port 91. Thus, a fuel flow F in the fuel injection port 91 has a doughnut-shaped cross section, and an average cross-sectional area of this fuel flow F which is perpendicular to the direction in which the fuel flow F advances shall be represented by S3. Let S1 equal a cross-sectional area (minimum cross-sectional area) of the minimum opening 92 in the condition in which the needle valve 7 is fully opened. The minimum cross-sectional area S1 of the minimum opening is set so that the following expression (3) is established.

$$S3<S1<S2 \tag{3}$$

Setting the minimum cross-sectional area S1 of the minimum opening smaller than the cross-sectional area S2 of the fuel injection port 91 can prevent a fuel having a small amount of fuel swirling energy from being injected in large quantities from the fuel injection port 91 in an initial period of an injection operation. Setting the minimum cross-sectional area S1 of the minimum opening larger than the average cross-sectional area S3 of the fuel flow F holds down the attenuation of the swirling energy applied by the fuel swirler 8 to the fuel. Thus, the principle of a free vortex that the vorticity of the fuel is maintained in the communication passage extending from the fuel swirl chamber 89 to the fuel injection port 91 is established. As a result, the fuel is injected from the fuel injection port 91 to the outside with sufficient swirling energy retained. During this time, the fuel is diffused excellently, and the atomization thereof much progresses, so that the above-mentioned problems to be solved by the present invention are dealt with successfully.

The cross-sectional area S2 of the fuel injection port 91 can be determined by actually measuring the inner diameter of the fuel injection port 91. When the detailed construction of the fuel injection system and the operating conditions therefor are determined, the minimum cross-sectional area S1 and average cross-sectional area S3 of the fuel flow F become substantially constant, and, accordingly, these cross-sectional areas S1, S3 can be actually measured or may be calculated by a method which will be described later. Although the minimum cross-sectional area S1 depends upon a distance between the needle valve 7 and valve seat 9 in the condition in which the minimum opening 92 is fully opened, it can be set to a desired level by regulating an axial stroke amount of the needle valve 7.

The minimum cross-sectional area S1 can be calculated as an area of an inclined surface of a frustum obtained when a segment Y (refer to FIG. 5) on a normal between the needle valve 7 and valve seat 9 in the minimum opening 92 with the needle valve 7 in a fully opened state is turned around the axis of the fuel injection system; i.e., in accordance with the following equation (4):

$$S1=\pi[(R+Y)^2-R^2]\cos(\theta/2) \tag{4}$$

wherein R represents the length (refer to FIG. 5) of an inclined surface of a removed pointed head portion of the frustum, and θ an angle of the valve seat.

A method of calculating the average cross-sectional area S3 of the fuel flow F will now be described. Since the vorticity is constant according to the principle of a free vortex, the following equations (5) and (6) are established on the basis of the above equation (2):

$$V_1Di=V_2Dc \tag{5}$$

$$S3=\pi(De^2-Dc^2)/4 \tag{6}$$

wherein $V_2$ represents a velocity of flow of the fuel in the fuel injection port 91, and Dc a diameter of a void of fuel in the fuel injection port 91. The $V_2$ is set so that a fuel pressure P/ρ, the potential energy supplied to an upstream side of the fuel swirler 8 is substantially converted into $V_2^2/(2g)$, kinetic energy with a fluid loss in the fuel injection port 91 kept low. Therefore, concerning $V_2$, the following equation (7) is established on the basis of the Bernoulli's theorem, and the following equation (8) on the basis of the equation (7).

$$V_2^2/(2g)=P/\rho \tag{7}$$

$$V_{2-\sqrt{(2gP/\rho)}} \tag{8}$$

wherein g represents gravitational acceleration ($m/s^2$), P a pressure of the fuel supplied to the fuel swirler 8, and ρ the density ($kg/m^3$). Therefore, the following equation (9) is established on the basis of the above equations (1), (6) and (8).

$$S3=(\pi/4)\{De^2-Q^2\sin^2\Theta Di^2\rho/(2gPA^2)\} \tag{9}$$

wherein Θ represents an angle (°) of the surfaces of the valve seat 9 and fuel swirler 8 at which these parts contact each other, with respect to the axes of the same parts, and this angle in the embodiment of FIG. 2 is 90°.

Mode 2 of Embodiment

Figure 6:
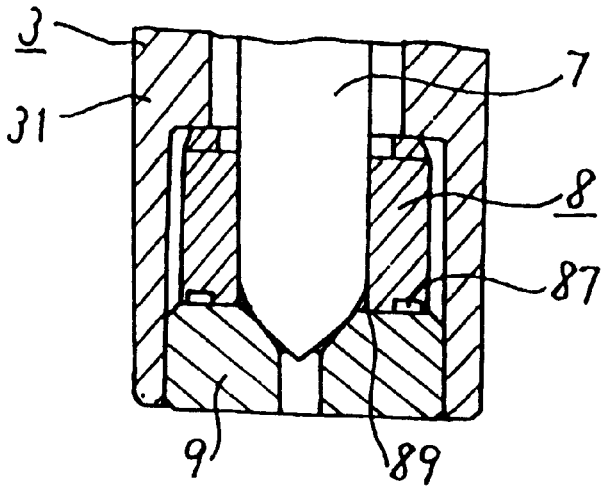
FIG. 6 is an enlarged sectional view of a fuel swirler in a mode 2 of embodiment of the present invention.

FIG. 6 is a sectional view of a fuel swirler and a portion in the vicinity thereof in a mode 2 of embodiment of the present invention, in which a reference numeral 89 denotes a fuel swirl chamber. In FIG. 6 and the drawings following the same, the parts identical with those shown in FIGS. 1–5 are designated by the same reference numerals.

In the previously described mode 1 of embodiment, the fuel swirl chamber 89 is formed by the outer surfaces of the annular groove 88 provided in a fuel swirler 8 and valve seat 9 and the side surface of the needle valve 7. On the other hand, a fuel swirl chamber 89 in the mode 2 of embodiment is defined by the side surfaces of the fuel swirler 8 and a needle valve 7 and an outer surface of a valve seat 9, and has a triangular cross section. Thus, the mode 2 of embodiment is different from the mode 1 of embodiment in the method of forming the fuel swirl chamber 89. The mode 2 of embodiment is advantageous in that the formation of the annular groove 88 communicating with the fuel swirler in the mode 1 of embodiment can be omitted to cause the cost of manufacturing the fuel swirler 8 to be reduced.

Mode 3 of Embodiment

Figure 7:
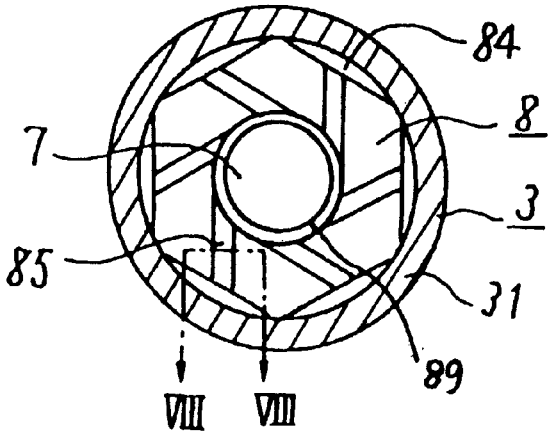
FIG. 7 is a partial enlarged plan in section of a valve seat-side surface of a fuel swirler in a mode 3 of embodiment of the present invention.
Figure 8:
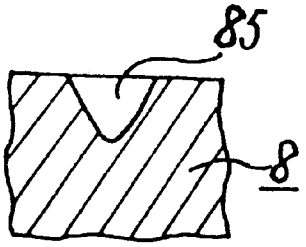
FIG. 8 is an enlarged sectional view taken along the line VIII—VIII in FIG. 7.

FIGS. 7–8 are drawings both of which illustrate a mode 3 of embodiment of the present invention. FIG. 7 is a cross-sectional view corresponding to FIG. 3. FIG. 7 shows a valve seat-side surface of a fuel swirler in plan, and FIG. 8 is an enlarged cross-sectional view taken along the line VIII—VIII in FIG. 7. Referring to FIGS. 7–8, a reference numeral 85 denotes swirl grooves provided in a fuel swirler 8. Each of the swirl grooves 85 in the previously-described mode 1 of embodiment has a square cross-sectional shape but each of the swirl grooves 85 in the mode 3 of embodiment has a V-shaped cross-sectional shape as shown in FIG. 8. The fuel swirler 8 is produced by using a mold, such as a mold of a sintered body. In order to obtain the swirl grooves 85 having a square cross-sectional shape, it is necessary to secure the strength of groove-forming portions of the mold. However, in order to obtain swirl grooves 85 having a V-shaped cross-sectional shape, the degree of securing the strength of the groove-forming portions of the mold may be at a lower level. In the case of the swirl grooves 85 having a square cross-sectional shape, the velocity of flow of the fuel flowing in the vicinity of bottom surfaces thereof becomes low as compared with that of the fuel flowing in the central portions thereof. On the other hand, in the case of the swirl grooves 85 having a V-shaped cross section, the volume of the groove bottoms is smaller, and a percentage of the fuel flowing at a low velocity of flow is smaller, so that an average velocity of flow of the fuel is higher than that of the fuel flowing in the cross-sectionally square swirl grooves. Thus, a fuel swirling energy application efficiency of the fuel swirler 8 is improved advantageously.

Even the swirl grooves having a non-square cross-sectional shape not limited to swirl grooves having a V-shaped cross section, in which the volume per unit length of each groove of the bottom portions or the portions thereof which are in the vicinity of the bottom portions is smaller than that of the upper portions of the same grooves, for example, cross-sectionally U-shaped swirl grooves, semicircular swirl grooves or some other shape of swirl grooves which have reduced volume of groove bottoms have advantages identical with those of the cross-sectionally V-shaped swirl grooves.

Mode 4 of Embodiment

Figure 9:
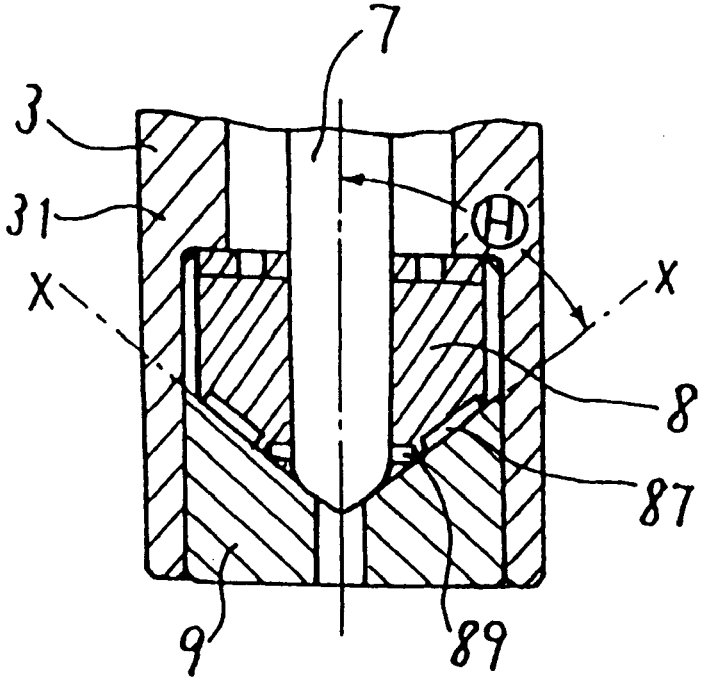
FIG. 9 is an enlarged sectional view of a fuel swirler and a portion in the vicinity thereof in a mode 4 of embodiment of the present invention.
Figure 10:
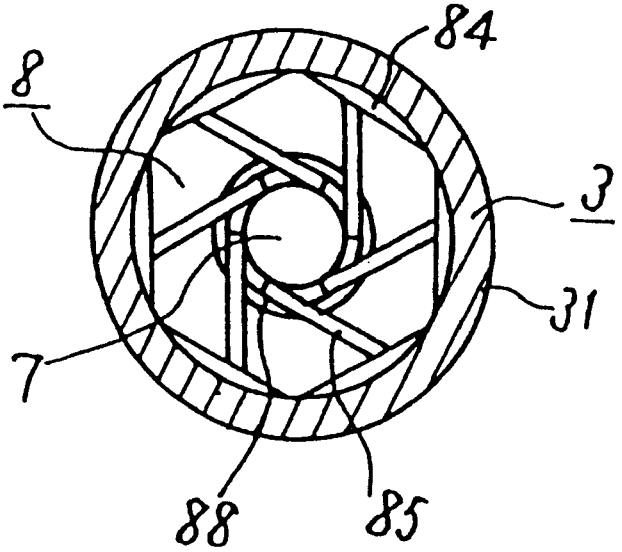
FIG. 10 is a sectional view taken along the line X—X in FIG. 9.

FIGS. 9–10 are drawings all of which illustrate a mode 4 of embodiment of the present invention. FIG. 9 is an enlarged sectional view of a fuel swirler and a portion in the vicinity thereof, and FIG. 10 a sectional view taken along the line X—X in FIG. 9. FIG. 10 also shows in plan a valve seat-side surface of the fuel swirler. The mode 4 of embodiment is different from the mode 1 of embodiment only in that surfaces of a fuel swirler 8 and a valve seat 9 at which these parts contact each other are inclined at an angle Θ with respect to the axes thereof. In this case, an average cross-sectional area S3 can also be determined in accordance with the above-mentioned equation (9). In the mode 1 of embodiment, the angle Θ is 90°, and the member sin Θhu 2 1. However, in the mode 4 of embodiment, this member is a value smaller than 1.

When the surfaces of the fuel swirler 8 and valve seat 9 at which these parts contact each other are inclined with respect to the axes thereof, swirl grooves 85, and, therefore, swirl passages 87 as well are inclined. Consequently, the variations of angle of a fuel passage extending from the swirl passages 87 to a clearance (communication passage) between a needle valve 7 and a valve seat 9 via a fuel swirl chamber 89 becomes gentler than that in the model of embodiment. Therefore, a flow resistance of a fuel becomes lower, so that a fuel flow is further stabilized. Since an efficiency of applying swirling energy to the fuel by the fuel swirler 8 decreases as the angle Θ decreases from 90°, the angle Θ is set to a level in the range of 45°–90°, and preferably to a level between not lower than 45° and lower than 90° when much importance is attached to the stabilization of a fuel flow.

As described above, the fuel injection system according to the present invention is (1) a fuel injection system including a cylindrical fuel swirler having plural swirl grooves, a valve seat engaged with a swirl groove-carrying surface of the fuel swirler and having a fuel injection port, an annular fuel swirl chamber formed between the fuel swirler and valve seat and communicating with the swirl grooves and fuel injection port, and a valve body adapted to be moved forward and backward in a cylindrical hole of the fuel swirler in the axial direction thereof and thereby engaged with and disengaged from the valve seat to cause a communication passage between the fuel swirl chamber and fuel injection port to be closed and opened, a minimum cross-sectional area S1 of a clearance between the valve body and valve seat with the communication port fully opened being smaller than an area S2 of the cross section of the fuel injection port which is perpendicular to the axis thereof, and larger than an average area S3 of the cross section of the fuel injection port which is perpendicular to the direction in which a fuel flow advances. Therefore, a principle of a free vortex by which a vorticity of the fuel in the communication passage extending from the fuel swirl chamber to the fuel injection port is maintained is established. As a result, the fuel is injected from the fuel injection port to the outside with the fuel retaining sufficient fuel swirling energy. During this time, the atomization of the fuel progresses, and the problems to be solved by the present invention are dealt with successfully. Moreover, the responsibility of a valve body becomes higher as compared with that of the valve body, which is set to an unnecessarily large stroke, of the related art fuel injection system disclosed in Japanese Patent Laid-Open No. 205408/1998 referred to above. This enables a high responsibility which, especially, a fuel injection system for inside-cylinder injection demands to be attained.

In (2) a fuel injection system, the fuel swirl chamber is formed so as to be surrounded by the walls of the fuel swirler, valve body and valve seat, so that it is not necessary to provide an annular groove for forming a fuel swirl chamber in the fuel swirler. Therefore, the cost of manufacturing the fuel swirler thereby decreases to advantage.

According to the present invention, the shape of the fuel swirl chamber may be circular, elliptic, polygonal or of some other shape as long as it extends annularly, and the direction in which the swirl grooves extend with respect to the fuel swirl chamber is not specially limited. In the (3) fuel injection system, the fuel swirl chamber is formed to a circularly annular shape, and the swirl grooves are formed so as to extend in the tangential direction of the fuel swirl chamber. This enables the flow resistance of the fuel to be maintained at a minimum level, and the swirling energy applying function of the fuel swirler to be utilized maximally.

In (4) fuel injection system, the surfaces of the fuel swirler and valve seat at which these parts contact each other are inclined with respect to the axes thereof. When the angle of inclination of these surfaces is not smaller than 45° and smaller than 90° as in (5) fuel injection system, the swirl passages are also inclined, so that variation of the angle of the fuel flow passage extending from the swirl passages to the communication passage between the needle valve and valve seat via the fuel swirl chamber becomes gentle. This causes the flow resistance of the fuel flow to become low, and the fuel flow to be more stabilized effectively.

When the average cross-sectional area S3 defined in (6) fuel injection system can be determined in accordance with the above equation (9), the minimum cross-sectional area S1 of the opening between the valve body and valve seat with the communication passage fully opened, and, furthermore, an optimum stroke amount of the valve body can be determined by making calculations on the basis of the detailed construction of the fuel injection system according to the present invention and various conditions for the supply fuel.

Moreover, when the swirl grooves of (7) fuel injection system have a non-square cross-sectional shape with the volume per unit length of each of the grooves of the groove bottoms and the portions thereof which are in the vicinity of the groove bottoms smaller than that of the upper portions of the grooves, the manufacturing of the fuel swirler by using a mold of a sintered body is done easily. Since the percentage of the fuel the velocity of flow of which becomes low due to the small volume of the groove bottoms is small, the average velocity of flow of the fuel is higher than that of the fuel flowing in the cross-sectionally square grooves. Accordingly, the fuel swirling energy application efficiency of the fuel swirler is improved.

What is claimed is:

1. A fuel injection system comprising a cylindrical fuel swirler having plural swirl grooves, a valve seat engaged with a swirl groove-carrying surface of the fuel swirler and having a fuel injection port, an annular fuel swirl chamber formed between the fuel swirler and valve seat and communicating with the swirl grooves and fuel injection port, and a valve body adapted to be moved forward and backward in a cylindrical hole of the fuel swirler in the axial direction thereof and thereby engaged with and disengaged from the valve seat to cause a communication passage between the fuel swirl chamber and fuel injection port to be closed and opened, wherein a minimum cross-sectional area S1 of a clearance between the valve body and valve seat with the communication port fully opened being smaller than an area S2 of the cross section of the fuel injection port which is perpendicular to the axis thereof, and larger than an average area S3 of the cross section of the fuel injection port which is perpendicular to the direction in which a fuel flow advances.

2. A fuel injection system according to claim 1, wherein the fuel swirl chamber is formed so as to be surrounded by walls of the fuel swirler, valve body and valve seat.

3. A fuel injection system according to claim 1, wherein the fuel swirl chamber is formed to a circularly annular shape, the swirl grooves extending in a tangential direction of the fuel swirl chamber.

4. A fuel injection system according to claim 1, wherein surfaces of the fuel swirler and valve seat at which these parts contact each other are inclined with respect to the axes thereof.

5. A fuel injection system according to claim 4, wherein an angle of inclination of the contact surfaces with respect to the mentioned axes is not smaller than 45° and smaller than 90°.

6. A fuel injection system according to claim 1 , wherein the average cross-sectional area S3 is determined by using the following equation:

$$S3=(\pi/4)\{De^2-Q^2 \sin^2 \Theta Di^2\rho/(2gPA^2)\}$$

wherein

De: an inner diameter (m) of the fuel injection port,

Q: a static flow rate ($m^3/s$) of a fuel supplied to the fuel swirler,

A: a total cross-sectional area ($m^2$)of the swirl grooves,

Di: a length (m) two times as large as an offset amount of the center line of the swirl grooves with respect to the center of the fuel swirl chamber, Θ: an angle (°) of surfaces of the valve seat and fuel swirler at which these parts contact each other with respect to the axes thereof, g: gravitational acceleration ($m/s^2$)

P: pressure ($kgf/m^2$) of the fuel supplied to the fuel swirler, and

ρ: density ($kg/m^3$) of the fuel.

7. A fuel injection system according to claim 1, wherein the swirl grooves have a non-square cross-sectional shape, the volume per unit length of each of the swirl grooves of groove bottoms or the portions of the grooves which are in the vicinity of the groove bottoms being smaller than that per unit length of each of the grooves of upper portions of the grooves.

* * * * *